US005685045A

United States Patent [19]

Lace

[11] Patent Number: 5,685,045

[45] Date of Patent: Nov. 11, 1997

[54] INTUMESCENT MATERIAL IN A CONTINUOUS PINLESS HINGE

[75] Inventor: James Lace, Dowagiac, Mich.

[73] Assignee: Select Products Limited, Kalamazoo, Mich.

[21] Appl. No.: 621,905

[22] Filed: Mar. 26, 1996

[51] Int. Cl.[6] ..... E05D 7/00

[52] U.S. Cl. ..... 16/354; 29/11

[58] Field of Search ..... 16/354, 222, 225, 16/250, 251; 29/11; 49/475.1, 477.1; 52/232

[56] References Cited

U.S. PATENT DOCUMENTS

| | | | |
|---|---|---|---|
| 3,332,184 | 7/1967 | McEvoy . | |
| 3,402,422 | 9/1968 | Baer | 16/354 |
| 3,955,330 | 5/1976 | Wendt . | |
| 3,964,214 | 6/1976 | Wendt . | |
| 4,045,930 | 9/1977 | Dixon . | |
| 4,144,688 | 3/1979 | Dixon . | |
| 4,354,304 | 10/1982 | Dixon . | |
| 4,649,089 | 3/1987 | Thwaites . | |
| 4,660,338 | 4/1987 | Wagner . | |
| 4,794,206 | 12/1988 | Weinstein | 16/354 |
| 4,953,261 | 9/1990 | Lyons | 16/354 |
| 4,993,203 | 2/1991 | Tanaka . | |
| 5,279,087 | 1/1994 | Mann . | |
| 5,355,625 | 10/1994 | Matsuoka . | |
| 5,448,799 | 9/1995 | Stein, Jr. | 16/225 |

*Primary Examiner*—Chuck Y. Mah

*Attorney, Agent, or Firm*—Knechtel, Demeur & Samlan

[57] ABSTRACT

Intumescent material in a continuous pinless hinge is provided. The intumescent material swells at a predetermined temperature triggering point and surrounds the hinge bearings. The intumescent material absorbs heat before it is transferred to the bearing, thereby increasing the time before the bearings fail.

18 Claims, 3 Drawing Sheets

INTUMESCENT MATERIAL IN A CONTINUOUS PINLESS HINGE

BACKGROUND OF THE INVENTION

1. Field of the Invention

The present invention relates generally to continuous pinless hinges, and more particularly to the use of intumescent material in continuous pinless hinges to protect the hinge bearings.

2. Prior Art

Continuous pinless hinges are becoming increasingly popular in the construction industry. They are easy to install, provide a smooth and accurate operation, and are long lasting. A continuous pinless hinge is one which by definition contains no pins as seen in the typical "butt" hinge. Instead, a continuous pinless hinge runs the entire length of the door. An opening mechanism is formed when the pivot gears of the two leaves of the hinge are interlocked. At strategic locations along the length of the hinge are bearings. The bearings provide support to the hinge and create the hinges smooth movement. The gear and bearings are covered by a bearing cap assembly. The bearing cap assembly provides additional structural support to the hinge by holding the leaves and bearings together and keeps debris from the moving parts of the hinge.

Also, modern construction practices require that fire and smoke stops be used in many settings. The advantage of such stops is obvious: They provide a means to slow the spread of fire and smoke, thereby increasing the chance that occupants can safely exit or be rescued from burning buildings.

Over the years, attempts to create effective fire and smoke stops have generally relied on intumescent materials in the door frame. Intumescent materials expand at a certain temperature triggering point, thereby creating a seal between the door and frame which slows the spread of fire and smoke. The intumescent materials used in fire and smoke stops typically begin to swell at 450° F.–500° F., and are generally one of two types: Hard puff and soft puff. Hard puff intumescent materials generally "explode," swell very quickly, and then become hard. The drawback of hard puff intumescent materials is that they can either blow out a hinge or set the door ajar. In either case, leaks can be created. Soft puff material swells more slowly than hard puff and forms around the solid materials in which it comes in contact. Once set, soft puff material also keeps some resiliency. Both of these qualities decrease the likelihood that leaks will occur.

An example of the prior art is found in U.S. Pat. No. 3,964,214. As with other art in this field, this patent focuses on creating a seal between the door and frame. However, a unique situation arises with a continuous pinless hinge. While the leaves of the hinge are protected by the door and the doorframe, the bearing cap assembly and, underneath it, the interlocking pivot gears and bearings are exposed. Fires can typically reach temperatures of 2300° F. Obviously there is little need to protect the hinge to these extreme temperatures. However, there is a need to protect the bearings which begin to melt at approximately 450° F. Once the bearings melt, the hinge integrity decreases. I have found that by improving the design of the bearing cap assembly by adding intumescent materials greater protection of the bearings results. This in turn increases the time before the bearings melt and the hinge assembly fails, leading to the potential for an increased fire rating and more lives saved. Thus, there is need for an inexpensive, effective way to protect the bearing cap assembly, and, more importantly, the bearings of a continuous pinless hinge during fire. This need has not been addressed in the prior art.

Even without this invention, continuous pinless hinges provide fire and smoke protection not seen with butt hinges. For example, the SL-11 and SL-24 continuous pinless hinges manufactured by Select Products of Kalamazoo, Mich., have a 20 minute rating with a hose stream for steel doors and a steel frame in drywall or masonry; a 20 minute rating without a hose stream for wooden doors in a steel frame in drywall or masonry; a 45 minute rating in steel or wooden doors in masonry; and, a 90 minute rating in a steel door and steel frame (16 gauge steel) in masonry.

I have found, however, that the use of heavy paper or cardboard saturated with an intumescent substance will, when activated, absorb heat. This phenomenon slows the transfer of heat to the bearings. Thus, the bearings remain cooler for a longer period of time which maintains the integrity of the hinge. Because the intumescent material is located on the exposed portion of the hinge, it will not set the door ajar, thereby offering assistance in maintaining the structural integrity of the hinge assembly.

OBJECTS OF THE INVENTION

Therefore, an object of this invention is to provide an improved continuous pinless hinge.

Another object of this invention is to provide a continuous pinless hinge bearing cap assembly which is specifically designed to hold intumescent material.

Another object of the invention is to provide a continuous pinless hinge containing intumescent materials.

Another object of this invention is to provide a continuous pinless hinge in which the hinge bearings are protected after the application of heat resulting in increased hinge integrity.

Another object of this invention is to provide an economical way to create an improved continuous pinless hinge.

Additional objects, advantages, and novel features of the invention will be set forth in part in the description which follows, and in part will become apparent to those skilled in the art upon examination of the following or may be learned by practice of the invention. The objects and advantages of the invention may be realized and attained by means of the instrumentalities and combinations particularly pointed out in the appended claims.

DISCLOSURE OF INVENTION

According to the present invention, the foregoing and other objects and advantages are attained by an improved continuous pinless hinge containing an intumescent material which increases the life of the hinge bearing during a fire. The apparatus is created by disposing intumescent materials into a channel formed by intumescent material recess and intumescent material retention lips in the bearing cap assembly. The bearing cap assembly is then secured to the hinge assembly.

DETAILED DESCRIPTION OF THE PREFERRED EMBODIMENT

Figure 1:
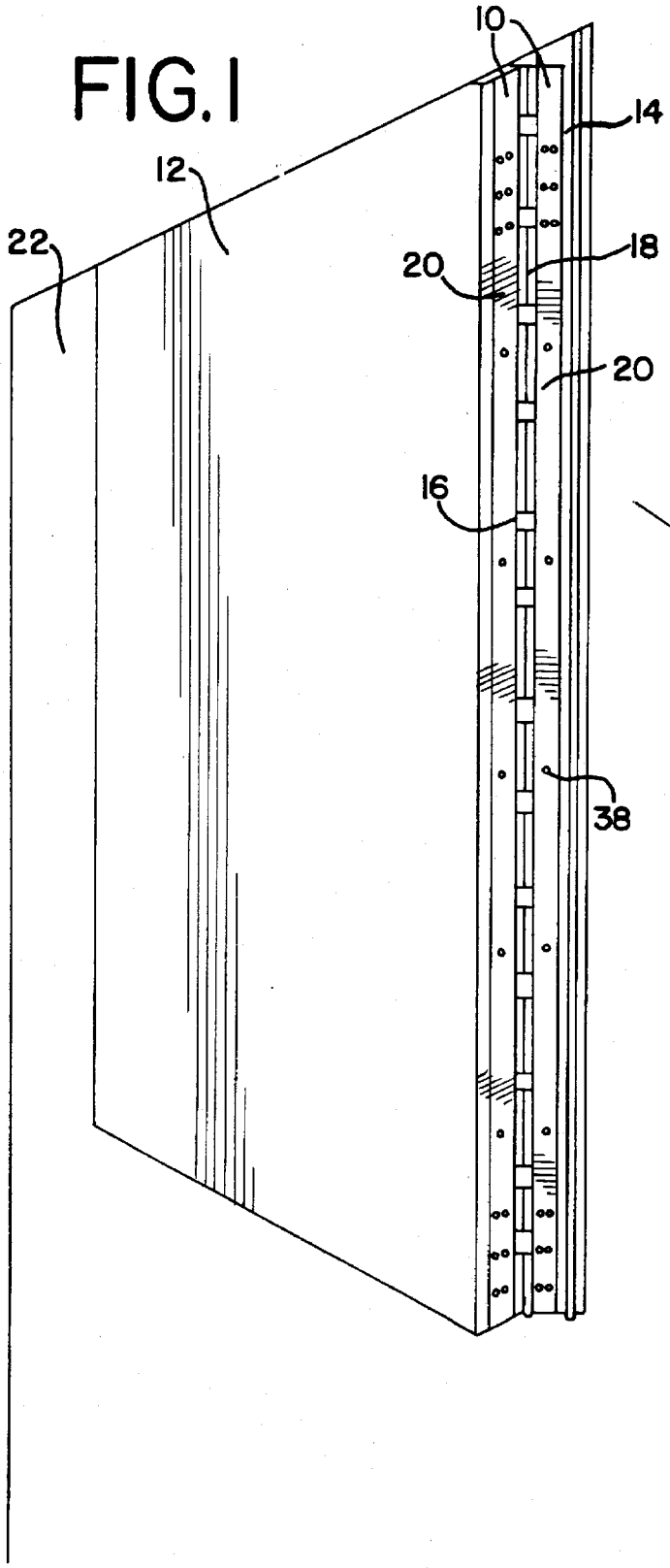
FIG. 1 is an open view of a mounted continuous pinless hinge.

The invention and further advantages and features thereof will now be explained in detail with reference to the attached drawings. FIG. 1 shows an open door 12 mounted in a doorway 22 by a continuous pinless hinge 10. The continuous pinless hinge 10 reveals two exposed hinge leaves 20 that possess on their innermost edges interlocking pivot gears 18 and strategically spaced bearings 16. As can be seen, the hinge 10 extends the entire length of the door 12. The hinge 10 is secured to the door 12 and door frame 14 via mounting means 38.

Figure 2:
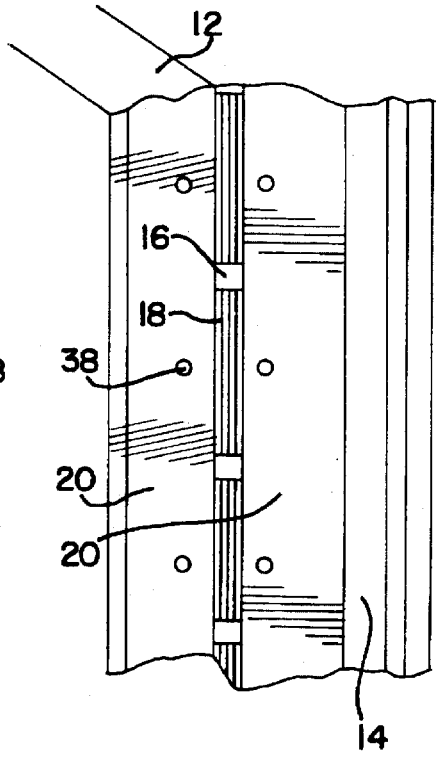
FIG. 2 is a closeup of an opened, mounted continuous pinless hinge.

The hinge operates by rotationally pivoting about the interlocking pivot gears. The strategically spaced bearings provide the structural support necessary to keep the hinge from slipping and the door properly aligned in the doorway, and to provide smooth, quiet operation. The bearings are typically made of a synthetic material having low friction, long-life capabilities, preferably a polyacetyl-based material or aluminum with synthetic material end fittings. FIG. 2 is a closeup of a section of a mounted opening hinge.

Figure 4:
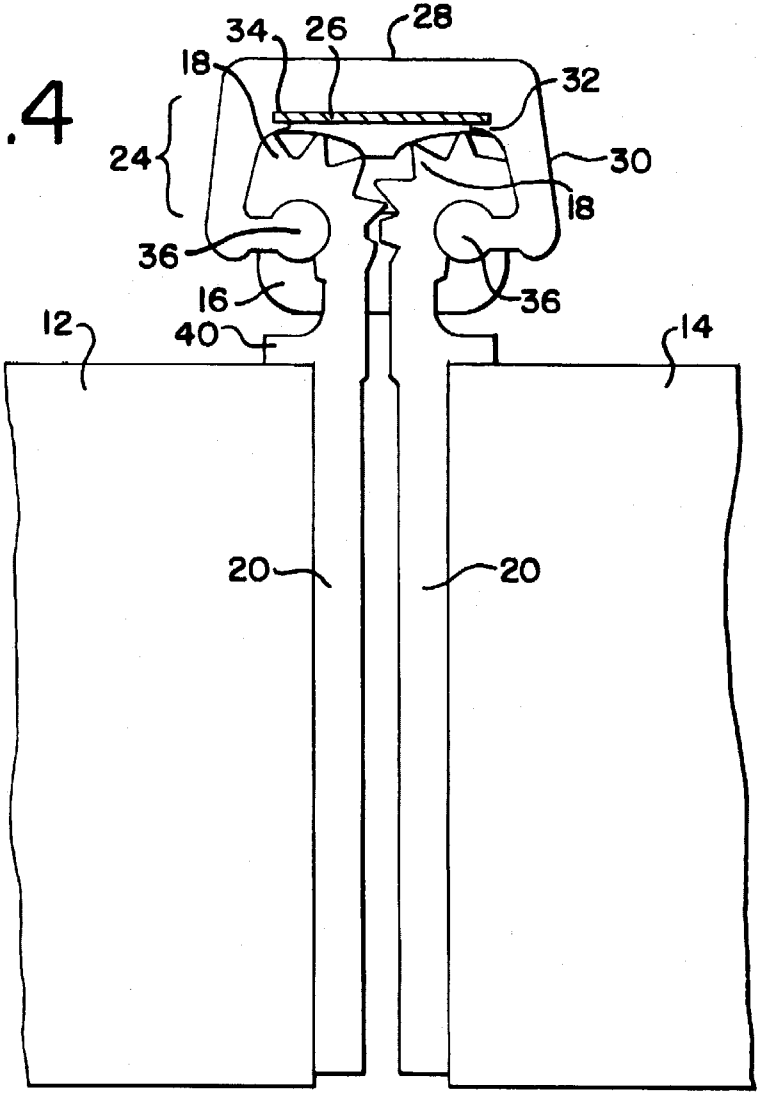
FIG. 4 is a top view of a continuous pinless hinge with intumescent material in the closed position.

FIG. 2 shows that when the door is in a closed position, the leaves are provided protection by the door 12 and door frame 14, leaving only the bearing cap 28 exposed. As can be seen in FIG. 4, however, the entire bearing cap assembly 24 is actually on the outward swing side of the door. It is clearly seen that the door 12 and frame 14 are protecting the leaves 20 but the bearing cap assembly 24, bearing 16 and interlocking pivot gears 18 are exposed.

Also seen in FIG. 4 is the improvement comprising intumescent material 26 affixed to the bearing cap 28 and supported by an intumescent material recess 34 and intumescent material retention lip 32.

The intumescent material is made of a combination of a flexible, absorbable material. While I found that heavy paper or cardboard approximately 0.016" thick is preferable, any suitable material, such as nylon mesh or cloth which is greater than 0.010" may be used. The most useful range appears to be 0.010" to 0.025" thick. The material should be the approximate width of the intumescent material recess 34 and the length of the bearing cap assembly 24. The flexible, absorbable material is then saturated with a substance having intumescent, or swelling properties. The intumescent substance must be able to swell when the temperature reaches approximately 450° F. as this is the temperature that the bearings begin to melt. By swelling prior to the time the bearings begin to melt, the intumescent material absorbs the heat that would have initially transferred to the bearings. By doing so, it takes a greater amount of time before the bearings reach the point of failure and the integrity of the hinge is lost.

While either a soft puff or hard puff intumescent material may be used, I have found that use of soft puff material is more advantageous inasmuch as soft puff material, when activated, conforms to the shape of the solids which it encounters. Thus, it surrounds the bearings while filling the crevices around them, offering more protection to the bearings, and will not cause the door to become ajar, causing leaks.

It is important to note that once the intumescent material swells, the door will not function as hinge movement is prevented by the intumescent material and the distortion of the hinge assembly.

Figure 3:
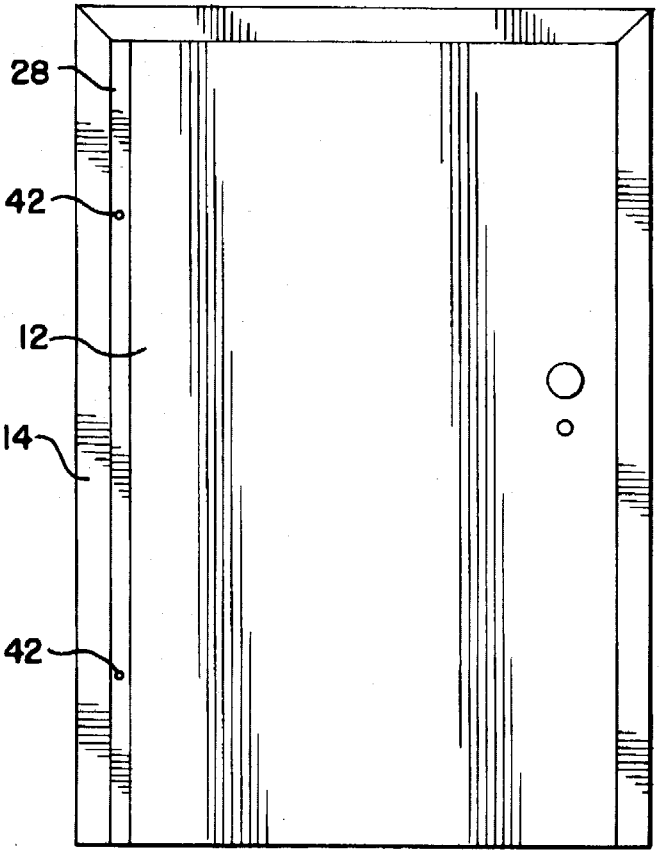
FIG. 3 is a view of a closed door displaying the exposed portion of a continuous pinless hinge.
Figure 6:
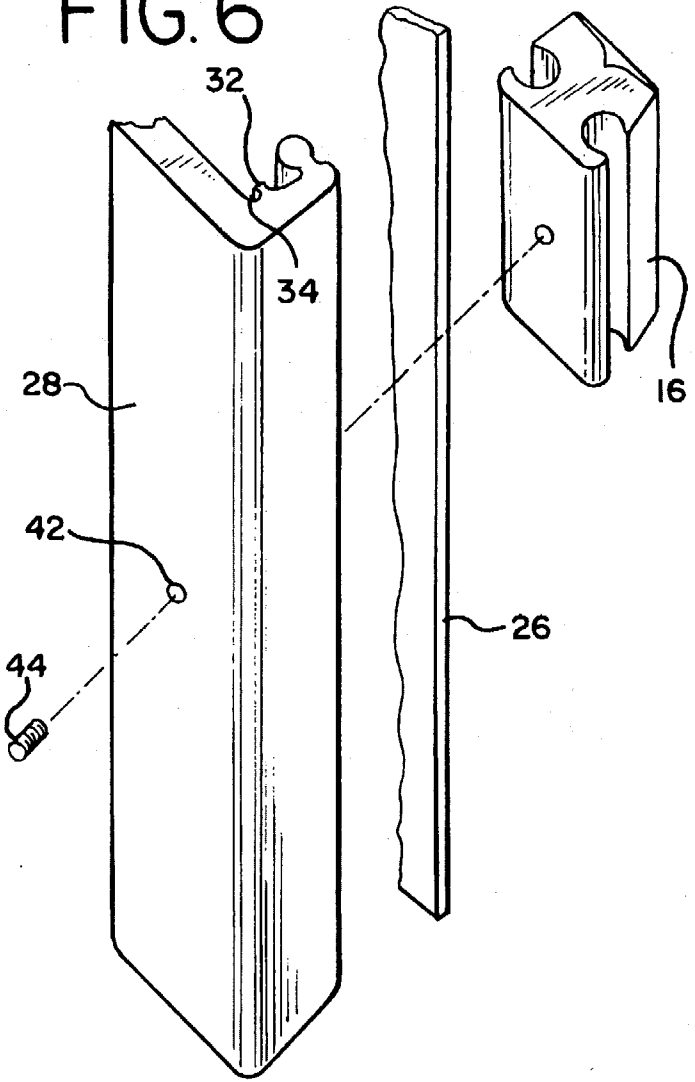
FIG. 6 is a partial view of a hinge focusing on the bearing cap, intumescent material, bearing, and set screws.
Figure 5:
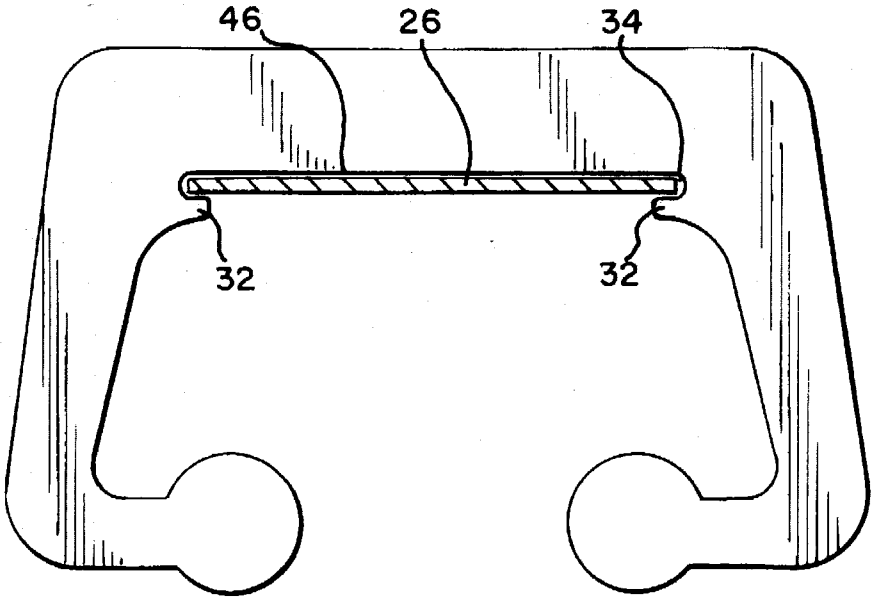
FIG. 5 is a top view of a continuous pinless hinge bearing cap with intumescent material.

In constructing the invention, it is seen in FIG. 5 that the intumescent material 26 is inserted into the channel 46 created by the intumescent material recess 34 and intumescent material retention lips 32 in the bearing cap 28. FIG. 4 shows that the bearing cap 28 is then mounted over the interlocking pivot gears 18 and bearings 16. FIG. 6 shows set screw holes 42 predrilled into the bearing cap and bearing, with one tapped bearing located near the top and one near the bottom of the hinge (FIG. 3). Set screws 44 are then inserted into the set screw holes and tightened so that they pierce the intumescent material 26 and come in contact with the bearings 16. The intumescent material recess 34 and intumescent retention lips 32 not only assist in the ease of assembly but also help prevent the intumescent material from coming in contact with the interlocking pivot gears 18. While set screws are used in the preferred embodiment, the use of an adhesive to secure the intumescent material to the bearing cap assembly is also contemplated.

I claim:

1. A heat resisting assembly for continuous pinless hinges comprising:

a bearing cap assembly having a back wall which has an outer side and an inner side, two side walls extending from the opposite ends of the back wall, an intumescent material recess located on the inner side of the back wall which extends essentially the entire width of the inner side, and two intumescent material retention lips, one of which extends inwardly from each of the side walls;

an intumescent material;

means for securing the bearing cap and intumescent material, interlocking pivot gears; and, bearings found at pre-determined locations along the interlocking pivot gears, whereby the intumescent material is disposed in the intumescent material recess and supported by the intumescent material retention lips of the bearing cap assembly, the bearing cap assembly containing the intumescent material then being placed over the interlocking pivot gears and bearings, and being secured into place by the securing means.

2. The apparatus of claim 1 wherein the securing means are at least two set screws.

3. The apparatus of claim 1 wherein the intumescent material is comprised of a flexible, absorbable substance and a heat activated swellable substance.

4. The apparatus of claim 3 wherein the flexible absorbable substance is paper or cardboard which is at least 0.010" thick.

5. The apparatus of claim 3 wherein the flexible absorbable substance is paper or cardboard which is between 0.010" and 0.025" thick.

6. The apparatus of claim 3 wherein the flexible absorbable substance is 0.016" thick.

7. The apparatus of claim 1 wherein the width of the intumescent material is approximately equal to the width of the intumescent material recess.

8. The apparatus of claim 1 wherein the intumescent material recess and intumescent material retention lips support the intumescent material and keep it from coming in contact with the interlocking pivot gears.

9. The apparatus of claim 1 wherein the intumescent material is of the type that expands when heat is applied to it, filling in crevices and retaining resiliency once it hardens.

10. A heat resisting assembly for continuous pinless hinges comprising:

a bearing cap assembly having a back wall which has an outer side and an inner side, two side walls extending from the opposite ends of the back wall, an intumescent material recess located on the inner side of the back wall which extends essentially the entire length of the inner side, and two intumescent material retention lips, one of which extends inwardly from each of the side walls;

an intumescent material of the type which expands when heat is applied to it, filling in crevices and retaining resiliency once it hardens;

means for securing the bearing cap and intumescent material;

interlocking pivot gears containing at least one bearing; and, the intumescent material being placed in the intumescent material recess and supported by the intumescent material retention lips of the bearing cap assembly, the bearing cap assembly then being displaced over the interlocking pivot gears and bearings, and being secured into place by the securing means.

11. The apparatus of claim 10 wherein the securing means are at least two set screws.

12. The apparatus of claim 10 wherein the intumescent material is comprised of a flexible, absorbable substance and a heat activated swellable substance.

13. The apparatus of claim 10 wherein the width of the intumescent material is approximately equal to the width of the intumescent material recess.

14. The apparatus of claim 12 wherein the flexible absorbable substance is paper or cardboard which is at least 0.010" thick.

15. The apparatus of claim 12 wherein the flexible absorbable substance is paper or cardboard which is between 0.010" and 0.025" thick.

16. The apparatus of claim 12 wherein the flexible absorbable substance is 0.016" thick.

17. The apparatus of claim 10 wherein the intumescent material recess and intumescent material retention lips support the intumescent material and keep it from coming in contact with the interlocking pivot gears.

18. A method for making a continuous pinless hinge containing intumescent material comprising the steps of:

creating a continuous pinless hinge having a door leaf, a frame leaf, an interlocking pivot gear, at least two bearings found at pre-determined locations along the length of the pivot gear, intumescent material, and a bearing cap assembly having means for accepting intumescent material, and at least two set screws;

placing a strip of the intumescent material into the bearing cap means for accepting intumescent material;

disposing the bearing cap assembly containing intumescent material over the pivot gears and bearings; and, securing the bearing cap assembly containing intumescent material to selected bearings with at least two set screws which are placed through strategically placed predrilled bearings, pierce intumescent material and affixed to the bearing cap assembly.

* * * * *